United States Patent [19]

Lamphier

[11] Patent Number: 4,573,635

[45] Date of Patent: Mar. 4, 1986

[54] CLOSED CIRCUIT HEATING SYSTEM

[76] Inventor: Wilbur N. Lamphier, 58 Kingsberry Ave., Westwood, N.J. 07675

[21] Appl. No.: 524,304

[22] Filed: Aug. 18, 1983

[51] Int. Cl.[4] ..... F24H 3/00; H05B 3/60

[52] U.S. Cl. ..... 237/70; 219/290; 219/307

[58] Field of Search ..... 219/306, 307, 304, 289, 219/290, 292; 237/56, 63, 66, 59, 70

[56] References Cited

U.S. PATENT DOCUMENTS

| | | | |
|---|---|---|---|
| 2,736,790 | 2/1956 | Alexander | 219/306 X |
| 2,813,964 | 11/1957 | Cerulli | 219/306 X |
| 4,296,883 | 10/1981 | Yanna | 237/56 X |

*Primary Examiner*—Henry Bennett

*Attorney, Agent, or Firm*—Darby & Darby

[57] ABSTRACT

A closed circuit heating system for use as a baseboard heater or the like comprises a sealed tank containing an annular heating element enveloping a heating rod, insulating means for mounting said annular heating element and heating rod in a fixed spatial relationship relative to each other and the tank, and means enabling said heating element and heating rod to be connected to a source of electricity. An elongated heat conducting outlet tube is connected to an elongated heat conducting return tube, the tubes being connected to the sealed tank with the outlet tube above the return tube to form a liquid flow path in the form of a loop. The heating element and heating rod are completely submerged in a heat conducting liquid, and both of the tubes are filled with the liquid.

1 Claim, 3 Drawing Figures

CLOSED CIRCUIT HEATING SYSTEM

This invention relates to closed circuit heating systems of the type used, for example, in connection with hot water baseboard heaters.

Baseboard heaters are used widely for residential heating. A type of baseboard heater that has gained popularity for such use includes an electric heating element which heats to boiling water which is then circulated through copper tubes to which heat exchanger elements are attached. Such baseboard heaters are sold in different lengths with a rating depending on the length of the heater.

A baseboard heater of the type to which this invention pertains is sold as a sealed unit so that no plumbing is required for installation. The heater may be permanently installed by relatively simple procedures or, if only 120 volts is required, the device may be made as a portable unit adapted to plug into a conventional wall socket.

OBJECTS OF THE INVENTION

The principal object of the invention is to provide an improved electric hot water baseboard heater.

More particularly, it is an object of this invention to provide an electric hot water baseboard heater which is relatively inexpensive to manufacture, highly reliable in operation, and which provides substantially improved efficiency.

SUMMARY OF THE INVENTION

In accordance with the invention, an electric hot water baseboard heater comprises a closed circuit system including a sealed tank containing an annular heating element enveloping a heating rod. The tank is connected to an elongated heat conducting outlet tube and a return tube which together form a liquid flow path in the form of a loop. The system is filled with a heat conducting liquid (e.g. water) such that the heating element and rod are entirely submerged and the liquid flow path completely filled. An expansion chamber is provided to relieve excess pressure within the system. After the device has been filled with water, air is evacuated so that the system operates under a partial vacuum.

THE DRAWINGS

DETAILED DESCRIPTION

Figure 1:
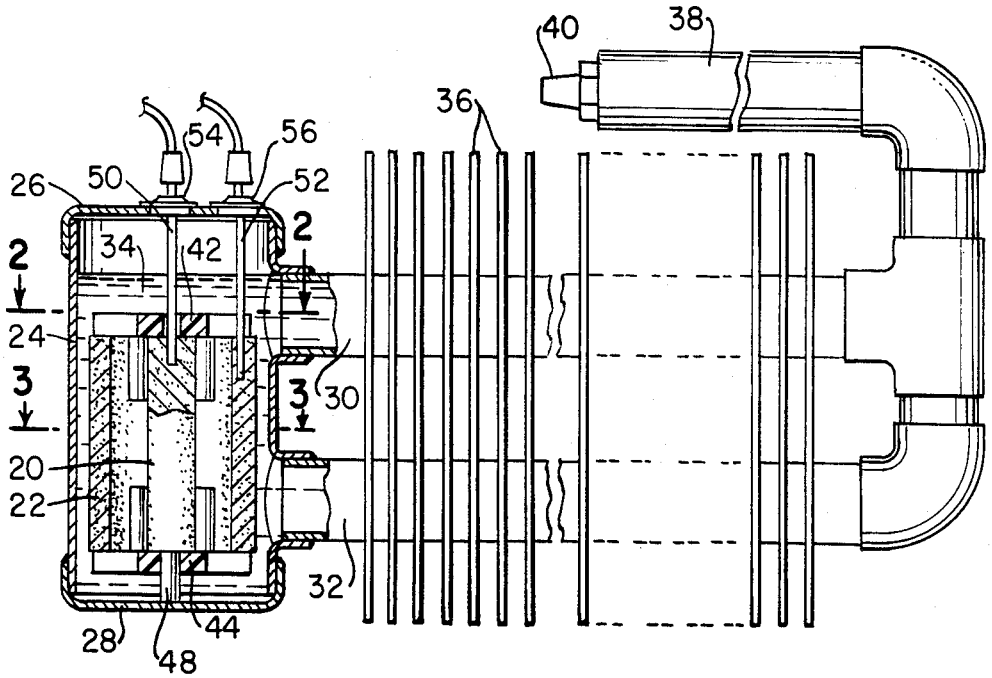
FIG. 1 is a side view, partially in section, of a closed circuit heating system in accordance with the invention.
Figure 2:
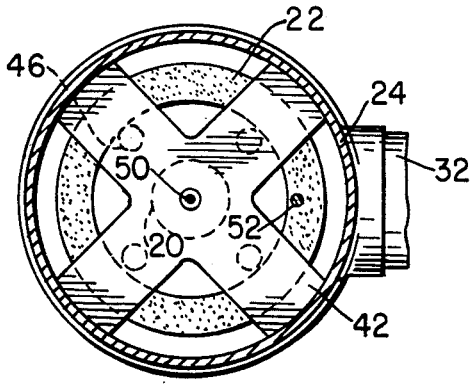
FIG. 2 is a sectional view along the line 2—2 of FIG. 1.

The drawings show a heating system in accordance with a preferred embodiment of the invention. Typically, the system as illustrated will be housed in a suitable enclosure (not shown). In accordance with the invention, the heating means comprises a central carbon rod 20 coaxially disposed within an annular heating element 22 also made of carbon or graphite. The carbon rod 20 and annular heating element 22 are supported within a sealed tank 24 which is cylindrical and closed by top and bottom caps 26 and 28, respectively. Tank 24 is connected to an elongated outlet tube 30, and a similarly elongated return tube 32. The outlet tube 30 and the return tube 32 are made of a heat conducting material such as copper and together form a liquid flow path in the form of a loop through which a liquid heating medium 34 can be circulated.

Heat exchanger means such as fins 36 (made of aluminum) are in a heat conducting relationship with both the outlet tube 30 and the return tube 32. At the far end of the loop, an expansion chamber is provided. The expansion chamber comprises a pipe 38 which extends back over the outlet tube 30 toward the sealed tank 24. The expansion chamber is terminated by a pressure valve 40 so that excessive pressure within the system can be relieved automatically.

Figure 3:
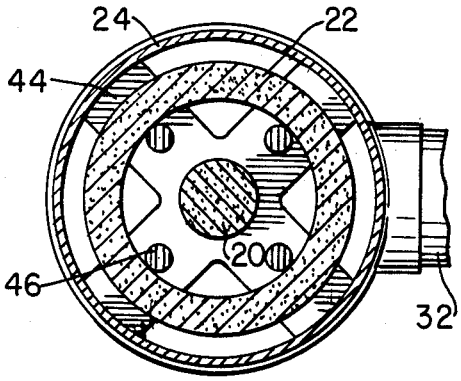
FIG. 3 is a sectional view along the line 3—3 of FIG. 1.

The carbon rod 20 and annular heating element 22 are mounted in suitable insulating retainers 42 and 44, respectively, so that they are securely held in a fixed spatial relationship with each other and the tank 24. By way of example, the insulating retainers 42 and 44 may each comprise a plastic member in the form of a cross (see FIG. 3) having downwardly dependent pins 46 which engage the inner surface of the annular heating element 22. The lower retainer 44 includes a central insulating pin 48 press-fit into a complementary bore within the heading rod 20.

The carbon rod 20 and annular heating element 22 are connecting electrically by wires 50 and 52 to terminals 54 and 56 in the top cap 26 which seals the tank 24. Construction of these terminals may be conventional and, therefore, is shown only diagramatically in FIG. 1.a The system as described is filled with water to an extent that the carbon rod 20 and annular heating element 22 are entirely submerged with the water coming at least to the top of the outlet tube 30 so that the entire liquid flow path as described above is filled. There is a small air space at the top of the tank and, likewise, a space above the liquid level in the expansion chamber where liquid can expand when heated. The construction of the retaining means (42 and 44) must be such as to permit water to pass between the carbon rod 20 and annular heating element 22 into circulation.

A principal feature of the invention is the fact that the liquid in the boiler tank 24 is at a partial vacuum. The vacuum may be created after the sealed system has been filled with liquid by applying a suitable vacuum pump to valve 40 with the structure positioned so that the tank 24 is completely filled with liquid. This low pressure causes the liquid to boil at a lower temperature then would otherwise be the case at atmospheric pressure. As the pressure builds up in the tank 24, the hot liquid is forced through the outlet tube 30. The circulating liquid is cooled in the return pipe 32 and this results in a drop in pressure. The cumulative effect is to create a pressure differential which tends to enhance circulation of the hot liquid. This, in turn, increases the efficiency of the heat transfer operation.

The liquid is heated by the flow of electric current between the carbon rod and the annular heating element. By controlling the conductivity of the fluid, the power requirements for units of different lengths may be controlled. Conductivity of the liquid may be controlled by using distilled water with a selected amount of ethylene glycol. For example, where the inlet and return tubes are 4.5 feet long, water containing 4% ethylene glycol by volume may be used.

What is claimed is:

1. A closed circuit heating system for use as a baseboard heater or the like, comprising a sealed tank containing an annular heating element enveloping a heating rod, insulating means for mounting said annular heating element and heating rod in a fixed spatial relationship relative to each other and the tank, said insulating means comprising upper and lower retaining members having vertically extending pins for engaging the inner surface of said annular heating element, and means enabling said heating element and heating rod to be connected to a source of electricity, an elongated heat conducting outlet tube connected to an elongated heat conducting return tube, said tubes being connected directly to said sealed tank with said outlet tube above said return tube to form a liquid flow path in the form of a loop, said loop being airtight, a heat conducting liquid in said tank and tubes, said heating element and heating rod being completely submerged in said liquid, and both of said tubes being filled with said liquid, and an airtight expansion chamber connected to said loop, said closed circuit heating system being evacuated of air at least in part so that the fluids in said system are at a pressure less than atmospheric.

* * * * *